US012546036B2

(12) United States Patent
Bühler et al.

(10) Patent No.: US 12,546,036 B2
(45) Date of Patent: Feb. 10, 2026

(54) TEXTILE STRUCTURE, AND MANUFACTURING PROCESS RELATED THERETO

(71) Applicant: Jakob Müller AG Frick, Frick (CH)

(72) Inventors: Stephan Bühler, Erlinsbach (CH); Bertram Wendisch, Buchs (CH)

(73) Assignee: JAKOB MÜLLER AG FRICK, Frick (CH)

( * ) Notice: Subject to any disclaimer, the term of this patent is extended or adjusted under 35 U.S.C. 154(b) by 0 days.

(21) Appl. No.: 19/065,646

(22) Filed: Feb. 27, 2025

(65) Prior Publication Data

US 2025/0290237 A1 Sep. 18, 2025

(30) Foreign Application Priority Data

Mar. 13, 2024 (IT) ..... 102024000005587

(51) Int. Cl.
*D03D 13/00* (2006.01)
*D03D 15/533* (2021.01)

(52) U.S. Cl.
CPC ..... *D03D 13/004* (2013.01); *D03D 15/533* (2021.01); *D10B 2401/16* (2013.01); *D10B 2403/0114* (2013.01); *D10B 2505/00* (2013.01)

(58) Field of Classification Search
CPC ..... D03D 13/004; D03D 15/533; D10B 2401/16; D10B 2403/0114; D10B 2505/00
See application file for complete search history.

(56) References Cited

U.S. PATENT DOCUMENTS 1,775,144 A * 9/1930 Sherman ..... D03D 1/00 160/DIG. 1
3,593,752 A * 7/1971 Moessinger ..... D03D 41/00 139/18
4,058,144 A * 11/1977 Dal Negro ..... A44B 19/54 139/384 B
4,456,035 A * 6/1984 Bruggemann ..... D03D 27/10 139/21
10,519,575 B2 * 12/2019 Thompson ..... A41D 3/08
10,900,147 B2 * 1/2021 Bogan ..... B68G 11/00
(Continued)

FOREIGN PATENT DOCUMENTS

KR 20230120250 A 8/2023

OTHER PUBLICATIONS

Search Report for Italian Application No. 102024000005587 mailed Sep. 26, 2024.

*Primary Examiner* — Robert H Muromoto, Jr.
(74) *Attorney, Agent, or Firm* — Perilla Knox & Hildebrandt LLP; Jason M. Perilla

(57) ABSTRACT

In a base fabric (2) having a front surface (F) and a back surface (B) at mutually opposite sides with respect to a median lying plane (P), weft yarns (4*a*, 4*b*, 4*c*) interlace with warp yarns (3) at respective interlacing points (IPa, IPb, IPc) at which the weft yarns cross the median lying plane (P) to override at least one of the warp yarns. At least one functional thread (5) extending along a pre-established pattern at the back surface (B) of the base fabric (2), without crossing the median lying plane (P), and is linked with the weft yarns (4*a*, 4*b*, 4*c*) at stitching points (SP) positioned between the median lying plane (P) and the back surface (B) of the base fabric (2), so that the stitching points (SP) are not visible from a front surface (F) opposite to the back surface (B).

15 Claims, 18 Drawing Sheets

(56) References Cited

U.S. PATENT DOCUMENTS

| | | | | |
|---|---|---|---|---|
| 2010/0013406 | A1 | 1/2010 | Bhattacharya | |
| 2014/0246415 | A1* | 9/2014 | Wittkowski | H05B 3/347 219/201 |
| 2017/0175305 | A1* | 6/2017 | Thompson | A41D 1/06 |
| 2020/0270779 | A1* | 8/2020 | Siebert | D03D 11/00 |
| 2022/0235499 | A1 | 7/2022 | Reimann et al. | |
| 2023/0096264 | A1 | 3/2023 | Engesser | |

* cited by examiner

Fig.12a
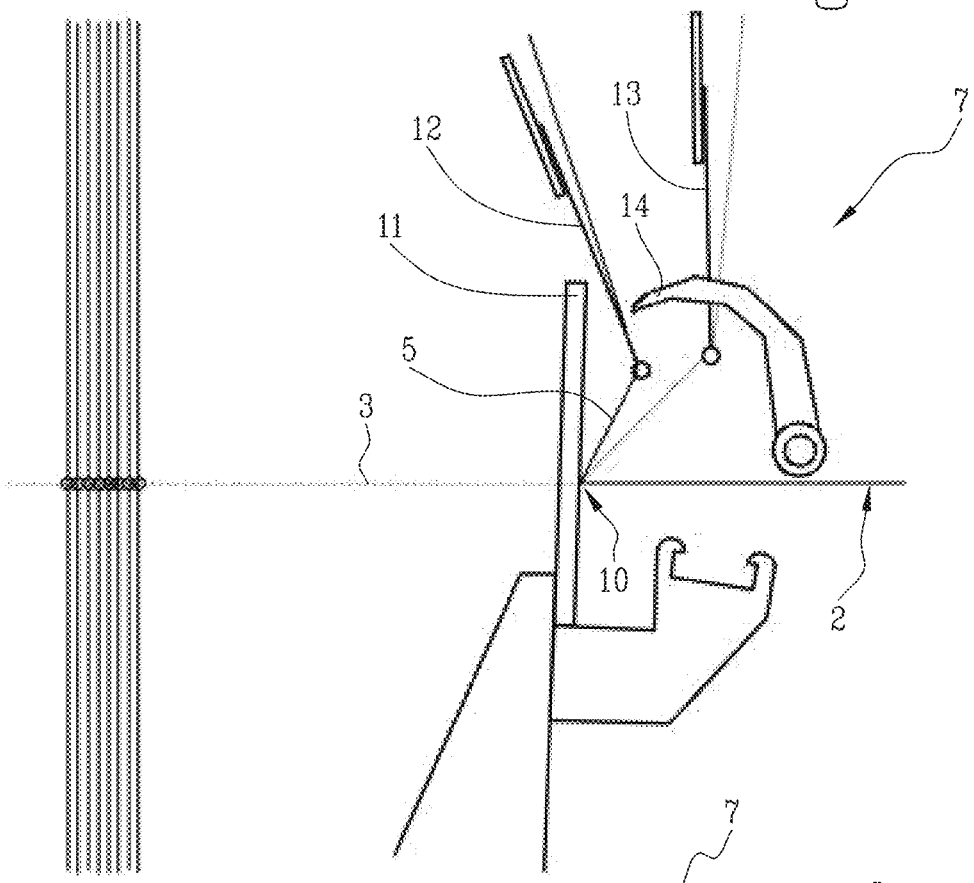
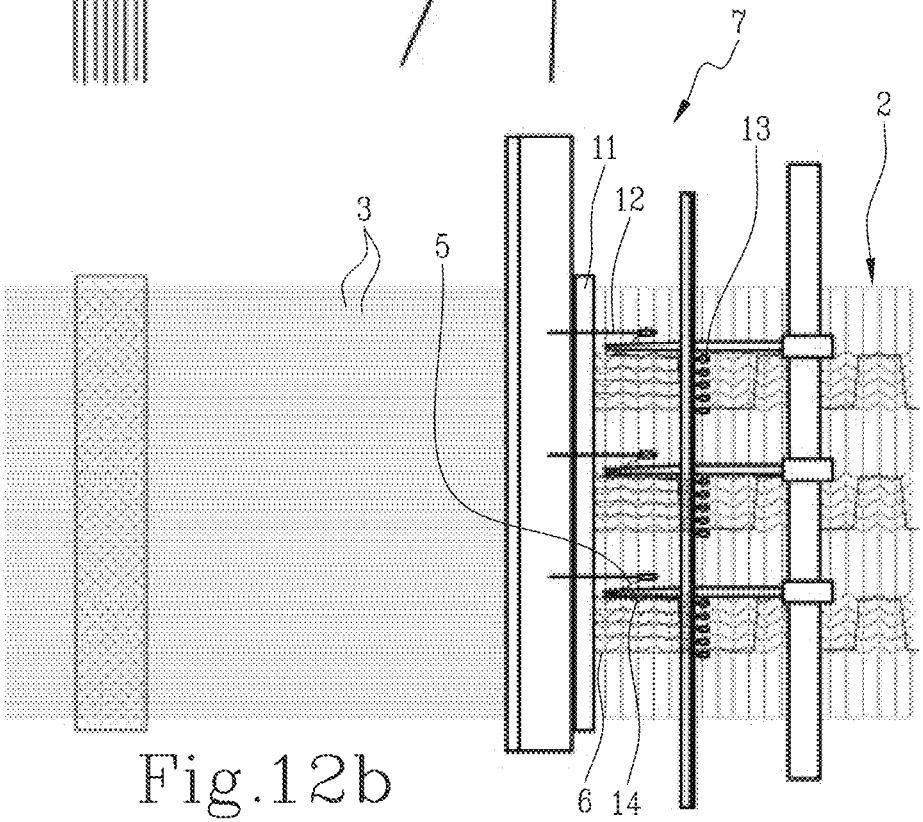
Fig.12b

Fig.13a
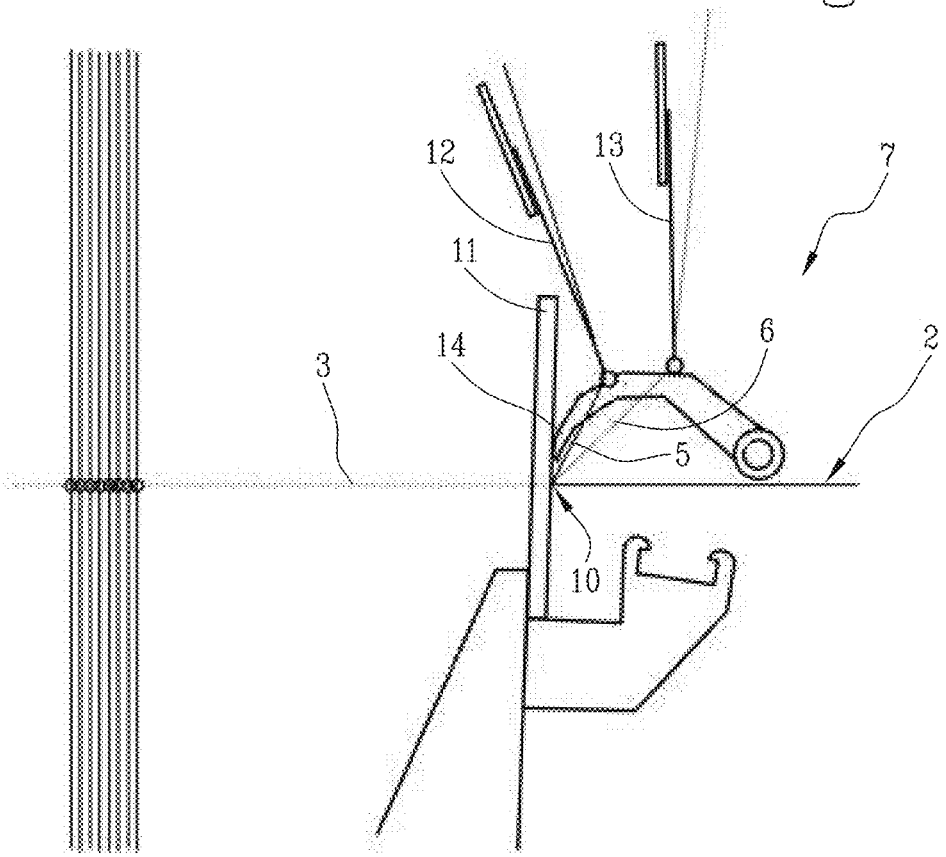
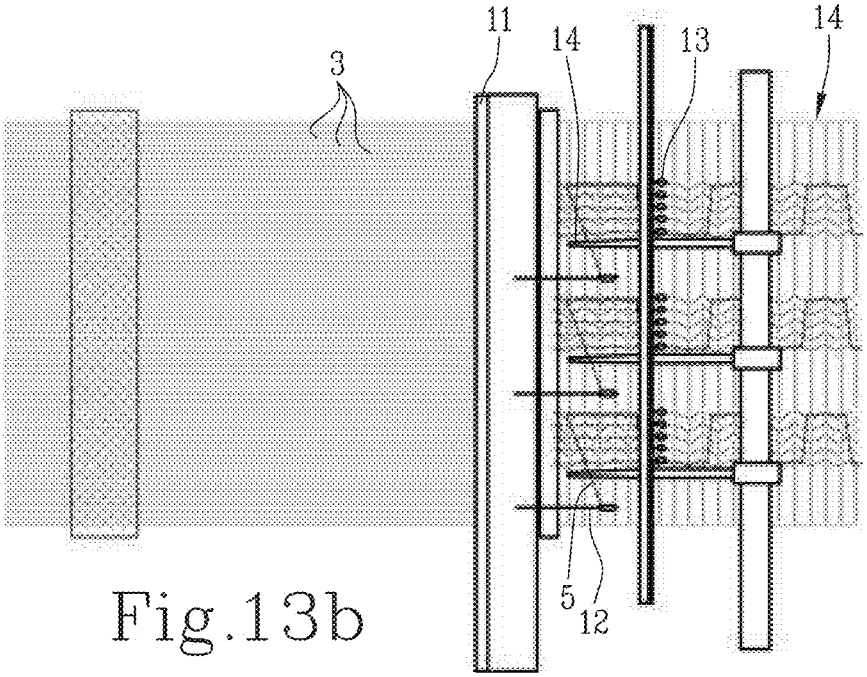
Fig.13b

Fig.14a
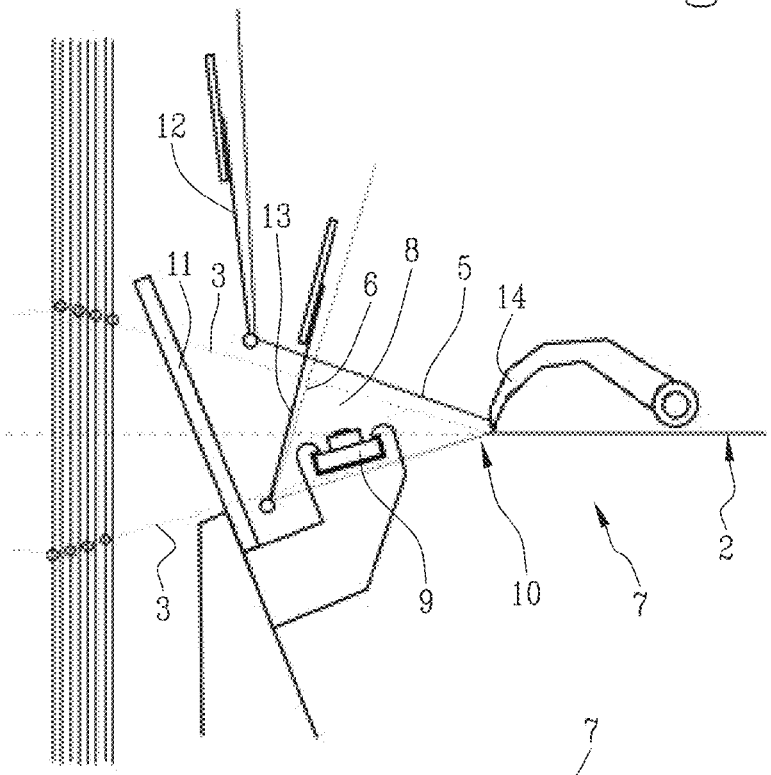
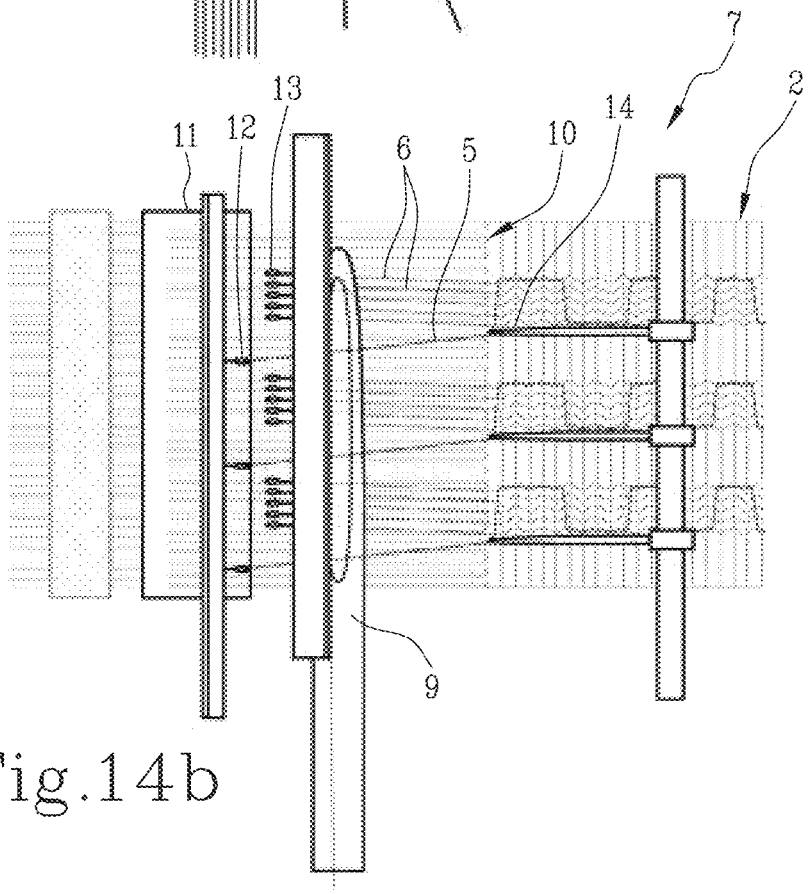
Fig.14b

Fig.15a
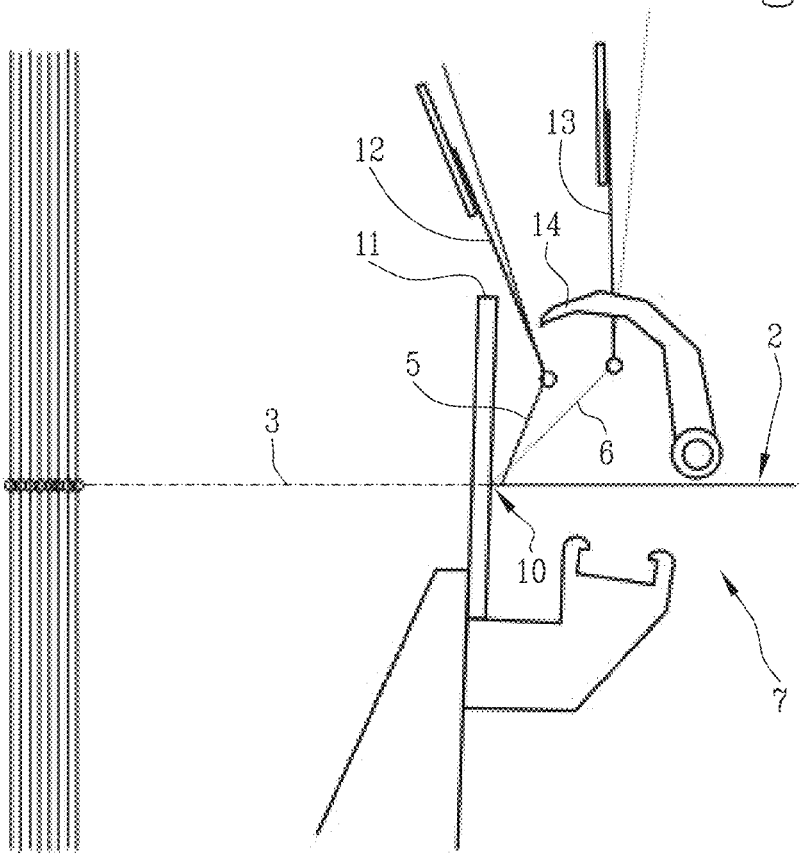
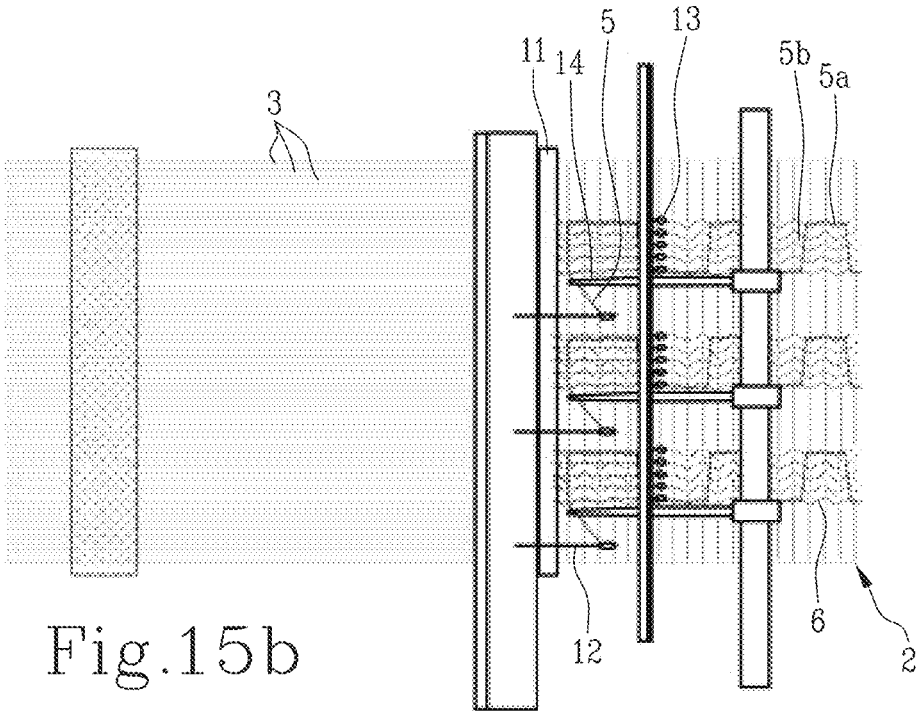
Fig.15b

TEXTILE STRUCTURE, AND MANUFACTURING PROCESS RELATED THERETO

CROSS REFERENCE TO RELATED APPLICATIONS

This application claims the benefit of and priority to IT patent application No. 102024000005587, flied Mar. 13, 2024, the entire disclosure of which is hereby incorporated herein by reference.

BACKGROUND

Several textile structures and relative weaving processes that provide additional and/or functional threads are known. For example, US 2022/235499 A1 discloses a woven structure wherein cover threads are laid in a zig-zag manner and are introduced into the warp thread shed from above by respective feed needles, in such a manner that they are interlaced by the weft thread carried by a weft insertion device and thereby bound into the woven fabric by means of the weft threads.

The edges of the zig-zag sequence secure the warp yarns preventing them from fraying. The edges of the zig-zag sequence may be additionally secured by a further cover thread, which is introduced with a further feed needle and may also adopt a zig-zag interlacing sequence.

US 2013/0118633 A1 discloses a weaving machine wherein fixing warp threads are inserted in the fabric during manufacturing by respective warp-lying elements. One or more additional cover thread, which may consist of conductive or functional threads, are also inserted according to a desired sequence by cover thread guides. The warp-laying elements can move in a transverse direction to cause the fixing warp threads to lay and tie down the cover thread along the warp thread direction, to allow for new patterns and effects.

US 2023/096264 A1 provides a textile structure wherein weft threads are located at certain points in the fabric in a floating manner over a plurality of adjacent warp threads. A cover thread, which may be a functional thread such as an RFID antenna, is positioned by means of a feed needle, underneath the floating weft thread at an arbitrary point between the beginning and the end of the floating weft thread. The cover thread is thereby tied in by the weft thread, whereby it is precisely positioned at the beginning or the end of the floating weft thread region, depending on the positions of the previous and of the subsequent joining or binding point.

The cover or functional thread may be laid on the base fabric without dipping within the open shed, while being secured to the fabric by an anchoring yarn which is dipped into the open shed and secured to the weft yarns of the base fabric.

SUMMARY

The present invention relates to a textile structure. The invention also relates to a process for manufacturing textile structures. More particularly, the subject textile structure is provided with one or more functional threads, suitable to satisfy specific technical needs. For example, the functional threads may consist of electrically conductive threads, used for transmitting signals or electric energy trough the textile structure, which may have the property of a textile circuit board. The electrically conductive threads may further function as resistors in the textile structure which has the properties of a heater. In particular, the electrically conductive thread may further function as an antenna loop associated to the textile structure, to form an RFID system after the application of an RFID.

In the present description, by either "yarn" or "thread" is meant any assemblage consisting of one or more yarns each made by a single continuous elongated element, or fibers twisted or laid together to form a continuous strand.

The known technical solutions in the related field have some limitations and drawbacks. Indeed, the stitching points of the functional thread with the base fabric tend to be visible from the front surface of the fabric. This circumstance makes the known technical solutions not suitable in certain applications e.g. in the case of incorporating functional threads into labels, where the appearance on the front surface of the fabric is of importance.

The aim of the present invention is essentially to overcome the problems encountered in the known technique, proposing a process and a textile structure that allows functional threads to be incorporated with a reduced impact on the appearance and aesthetic features on the front surface of the base fabric.

In particular, the invention aims to allow production of textile structures incorporating functional threads and which at the same time are suitable for use in applications involving high quality requirements also from an aesthetic point of view, such as in the production of labels, edging elements, or inserts in garments.

A further purpose of the present invention is to propose a textile structure that lends itself to being obtained at low cost through a simplified weaving process.

More particularly, an object of the present invention is a textile structure according to one or more of claims 1 to 11, comprising: a base fabric including warp yarns extending along a warp direction and weft yarns extending along a weft direction; wherein the base fabric presents a front surface and a back surface at mutually opposite sides with respect to a median lying plane of the base fabric; wherein the weft yarns interlace with the warp yarns at respective interlacing points at which the weft yarns cross the median lying plane to override at least one of the warp yarns; further comprising at least one functional thread extending according to a pre-established pattern at the back surface of the base fabric; wherein the at least one functional thread lies on the base fabric without crossing the median lying plane; and wherein the functional thread is linked with one or more of the weft yarns at stitching points positioned between the median lying plane and the back surface of the base fabric, so that the stitching points are not visible from a front surface opposite to the back surface.

A further aspect of the invention relates to a process for manufacturing a textile structure, according to one or more of claims 12 to 15 comprising: arranging warp yarns extending along a warp direction, according to a first series of warp yarns mutually alternated with a second series of warp yarns; inserting weft yarns along a weft direction transverse to the warp direction, across an open shed formed by the first and second series mutually converging at a weaving region along the warp direction; mutually swapping the first and second series to interlace the weft yarns with the warp yarns at the weaving region, whereby a base fabric is formed by the weft yarns interlaced with the warp yarns at respective interlacing points; laying at least one functional thread on the warp yarns near the weaving region, the functional thread lying on a back surface of the base fabric, without crossing a median lying plane of the base fabric; linking the at least one functional tread to the weft yarns by stitching points placed between the median lying plane and the back surface, so that the stitching points are not visible from a front surface of the base fabric opposite to the back surface.

The applicant considers that arranging the stitching points at the back surface of the textile structure, namely between the respective weft yarn(s) and corresponding warp yarn(s), or anyway between the median lying plane and the back surface (i.e., over the median lying plane towards the back surface of the base fabric), allow to efficiently conceal the interlacing points when the textile structure is seen at the front surface side. The quality of the textile structure is therefore improved in regard to appearance and aesthetics, with significant advantage especially in regard to labels and/or similar articles wherein visual appearance is a key requirement.

In at least one form of preferential execution, the invention further includes one or more of the preferential features listed below.

Preferably, the weft yarns include: mutually parallel basic weft yarns; and anchoring weft yarns configured for linking the at least one functional thread with the base fabric. Preferably, interlacing points formed by the basic weft yarns are respectively aligned along the warp direction. Preferably, interlacing points formed by the anchoring weft yarns are staggered along the weft direction, with respect to interlacing points formed by the basic weft yarns. Preferably, the basic weft yarns and the anchoring weft yarns are obtained from a same continuous thread.

Preferably, the basic weft yarns and the anchoring weft yarns are obtained from respectively distinct continuous threads. Preferably, at the front surface of the base fabric, the interlacing points of the anchoring weft yarns are covered by the basic weft yarns, so that the interlacing points formed by the anchoring weft yarns are not visible from the front surface.

Preferably, at the front surface of the base fabric, the interlacing points of the anchoring weft yarns are interposed between the basic weft yarns and the warp yarns. Preferably, on the front surface of the base fabric, the basic weft yarns present floating stretches each extending straight over a group of the warp yarns between respective interlacing points. Preferably, the floating stretches of mutually adjacent basic weft yarns cover the interlacing points of the anchoring weft yarns. Preferably, the weft yarns further include pattern weft yarns having exposed stretches facing at the front surface of the base fabric upon the basic weft yarns, and hidden stretches facing at the back surface of the base fabric.

Preferably, provision is made of at least one fixing yarn interlaced with said weft yarns and at least one functional thread at the back surface of the base fabric, to link the functional thread with the base fabric. Preferably, the at least one fixing yarn is interlaced with said anchoring weft yarns. Preferably, the functional thread has warp-wise stretches extending along the warp direction and weft-wise stretches transverse to the warp direction. Preferably, the at least one fixing yarn extends according to a zig-zag pattern overriding the functional thread along the longitudinal development thereof. Preferably, each of said at least one functional thread is interlaced with the anchoring weft yarns by a plurality of mutually parallel fixing yarns, each substantially extending along the warp direction.

Preferably, each fixing yarn is stitched to the anchoring weft yarns by stitching points homogeneously distributed according to a zig-zag pattern developing along the warp direction. Preferably, at least one of the fixing yarns extends according to a zig-zag pattern overriding the warp-wise stretches of the functional thread.

Preferably, at least one of the warp-wise stretches of the functional thread extends according to a zig-zag pattern overriding one of the fixing yarns. Preferably, the weft yarns directly engage with the functional thread at the back surface of the base fabric. Preferably, the functional thread is directly engaged with at least one of the anchoring weft yarns. Preferably, inserting the weft yarns includes inserting basic weft yarns and inserting anchoring weft yarns across the open shed at respectively subsequent weaving cycles, the functional tread being linked to the anchoring weft yarns. Preferably, provision is made of inserting pattern weft yarns across the open shed. Preferably, linking the at least one functional thread comprises forming by a fixing yarn at least one stitching point engaging the anchoring weft yarn and the functional thread.

Preferably, forming said at least one stitching point comprises: inserting the fixing yarn in the open shed across one of said series of the warp yarns; and interlacing the fixing yarn by the weft yarns introduced across the open shed. Preferably, in the textile structure the at least one fixing yarn is interlaced by the weft yarns at stitching points distributed at opposite sides of the functional thread along the longitudinal development of the latter. Preferably, a plurality of fixing yarns are interlaced by the weft yarns, each at stitching points distributed at opposite sides of one of said warp yarns, along the longitudinal development of the latter. Preferably, linking the at least one functional thread comprises interlacing said functional thread with the respective weft thread at the stitching points. Preferably, provision is made of: inserting the functional thread in the open shed across one of said series of the warp yarns; and interlacing the functional thread by the weft yarns introduced across the open shed.

BRIEF DESCRIPTION OF THE DRAWINGS

Additional features and advantages will be better clarified by the detailed description of a preferred but not exclusive embodiment of a textile structure and a manufacturing method thereof, in accordance with the present invention. Such description will be set forth hereinbelow with reference to the set of drawings, merely provided as a non-limiting example, wherein:

FIGS. 12*a* to 15*a* schematically show in side elevation view respective phases of a process for manufacturing the textile structure according to the second embodiment of FIG. 11;

FIGS. 12*b* to 15*b* schematically show in top plan view the phases of FIGS. 12*a* to 15*a;*

DETAILED DESCRIPTION

Figure 1:
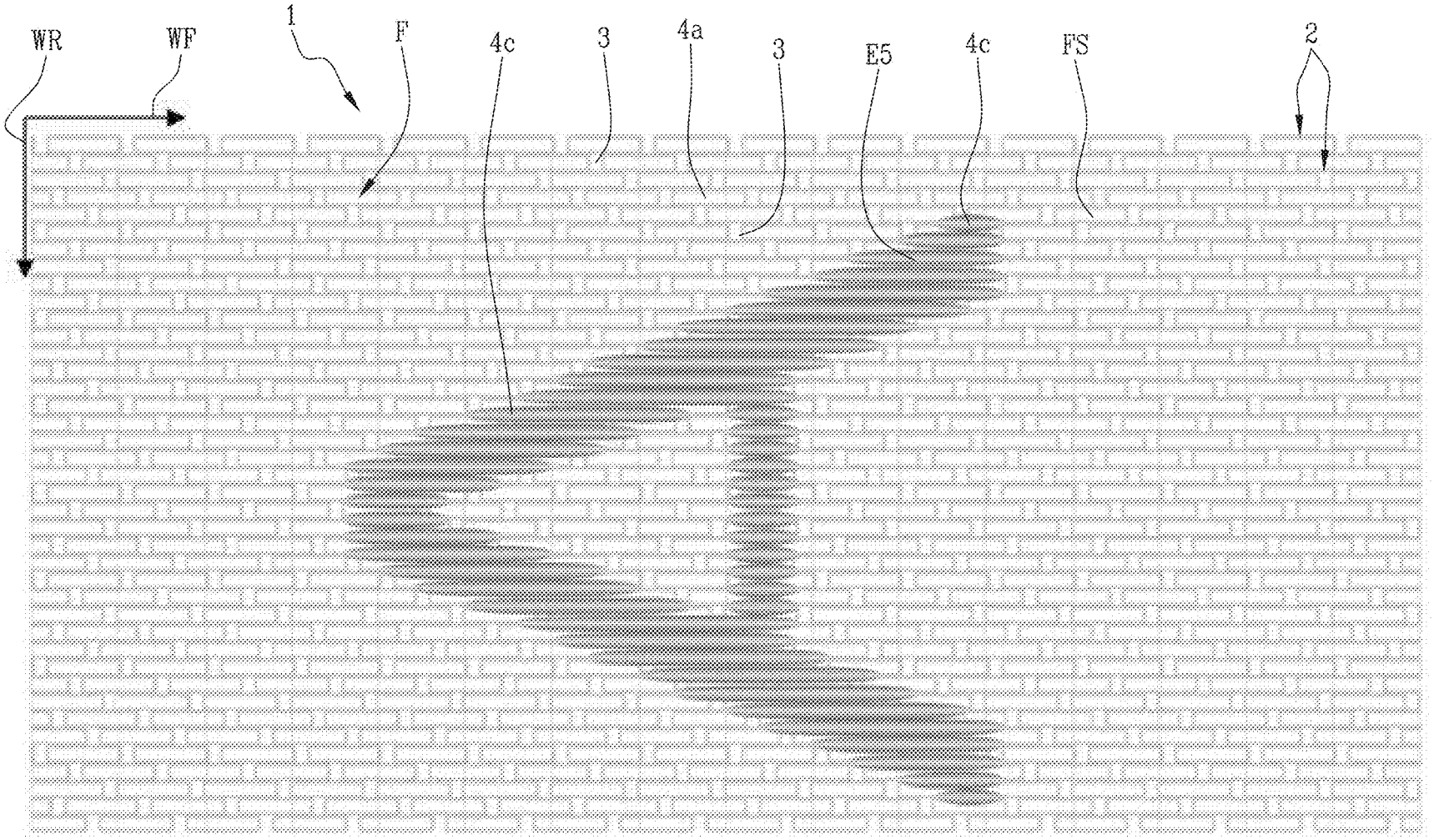
FIG. 1 schematically shows a top view of a textile structure according to the invention, seen toward the front surface of a base fabric thereof.

With reference to the attached figures, a textile structure according to the present invention is indicated by the reference number 1. The textile structure 1 comprises a base fabric 2 including warp yarns 3 extending along a warp direction WR and weft yarns 4*a*, 4*b*, 4*c* extending along a weft direction WF. The weft direction WF is substantially perpendicular or anyway transverse to the warp direction WR.

In the examples herein shown, the warp yarns 3 lay preferably on a common plane, and a median lying plane P of the base fabric 2 is defined, containing the longitudinal geometric axes of the warp yarns 3. In possible alternative embodiments, the warp yarns 3 may be mutually staggered. In this latter case, the median lying plane P of the base fabric 2 is equidistant from the longitudinal geometric axes of the mutually staggered warp yarns 3.

The base fabric 2 presents a front surface F and a back surface B extending mutually parallel and equidistant to the median lying plane P, at respective opposite sides with respect to this latter.

The weft yarns 4*a*, 4*b*, 4*c* interlace with the warp yarns 3 at respective interlacing points IP. At each interlacing point IPa, IPb, the respective weft yarn 4*a*, 4*b*, 4*c* crosses the median lying plane P. Each weft yarn 4*a*, 4*b*, 4*c* may interlace with the warp yarns 3 according to any desired sequence wherein, between every two mutually subsequent interlacing points IPa, IPb, the respective weft yarn 4*a*, 4*b*, 4*c* overrides one or more of the warp yarns 3, alternatively shifting from the front surface F side to the back surface B side, and vice-versa, across the median lying plane P. Preferably, at least basic weft yarns 4*a* and anchoring weft yarns 4*b* are discernible among the weft yarns 4*a*, 4*b*, 4*c*.

The basic weft yarns 4*a* are preferably formed according to one or more groups, each consisting of two or more basic weft yarns 4*a*, extending mutually parallel to engage the warp yarns 3 according to a same basic interlacing sequence which is identical for all the basic weft yarns 4*a* belonging to the same group. Basic interlacing points IPa formed by the basic weft yarns 4*a*, or each group thereof, are therefore respectively aligned along the warp direction WR. Preferably, at least on the front surface F of the base fabric 2, the basic weft yarns 4*a* present floating stretches FS each extending straight over a group of the warp yarns 3, between the respective basic interlacing points IPa.

The anchoring weft yarns 4*b* interlace with the warp yarns 3 according to an anchoring interlacing sequence, preferably different from the basic interlacing sequence. According to the anchoring interlacing sequence, anchoring interlacing points IPb formed by the anchoring weft yarns 4*b* are staggered along the warp direction WR, with respect to basic interlacing points IPa formed by the basic weft yarns 4*a*.

If required, the basic weft yarns 4*a* and the anchoring weft yarns 4*b* may be obtained from a same continuous thread that is supplied during the weaving process so to interlace with the warp yarns 3 according to the 5 mutually distinct basic interlacing sequence and anchoring interlacing sequence, to define the basic weft yarns 4*a* and the anchoring weft yarns 4*b*, respectively. In a further embodiment, distinct continuous threads, possibly differing in material, diameter, color etc., may be provided to form the basic weft yarns 4*a* and anchoring weft yarns 4*b*, respectively.

Figure 2:
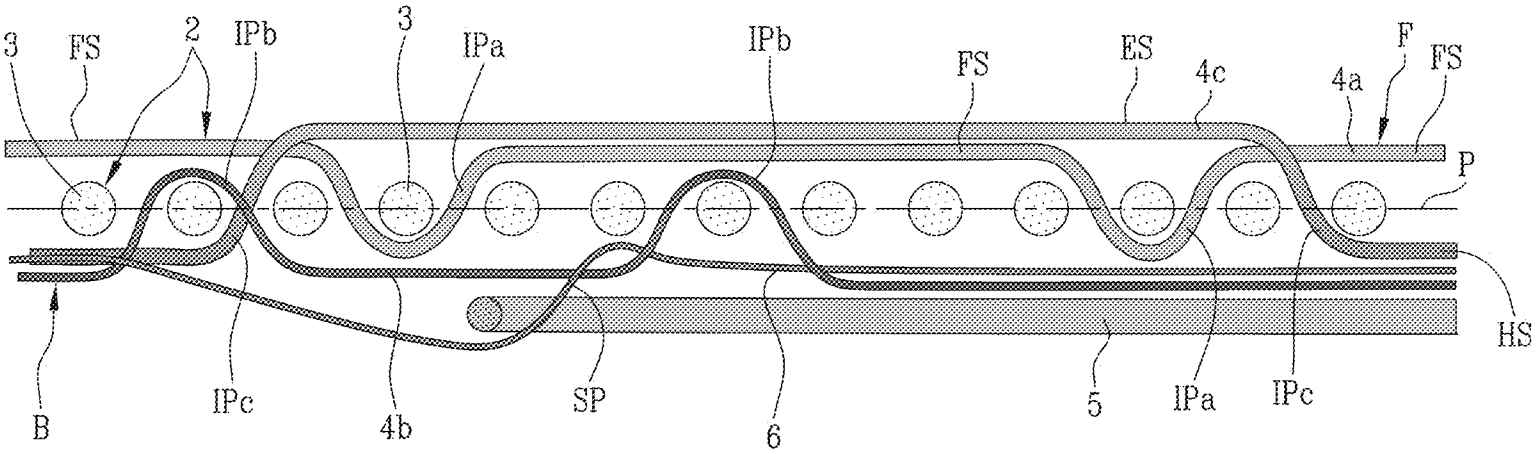
FIG. 2 is a schematic transverse section of the textile structure taken along a section plane parallel to a weft direction WF.
Figure 17:
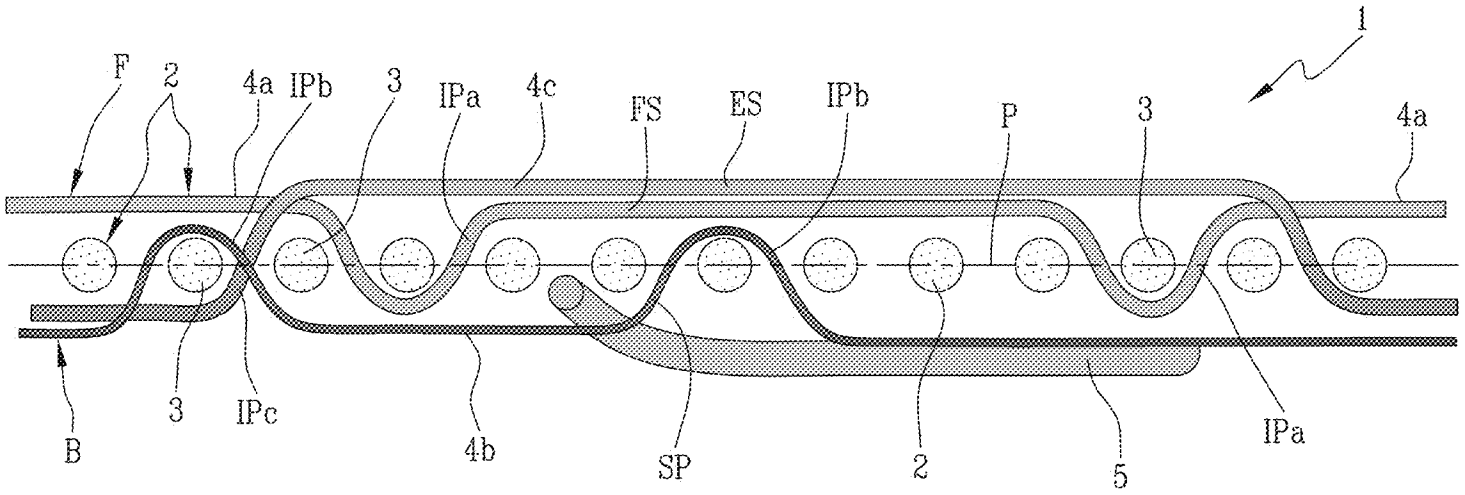
FIG. 17 is a schematic transverse section of the textile structure, taken along a section plane parallel to a weft direction WF, according to a fourth embodiment.

The anchoring interlacing points IPb may be covered by the basic weft yarns 4*a* at the front surface F of the base fabric 2. Indeed, the floating stretches FS of mutually adjacent basic weft yarns 4*a* may cover all the anchoring interlacing points IPb of the anchoring weft yarns 4*b*, or a part of them, as schematically shown in FIGS. 2 and 17. The anchoring interlacing points IPb are thus interposed between the basic weft yarns 4*a* and the warp yarns 3 of the base fabric 2. These measures facilitate concealing the anchoring interlacing points IPb formed by the anchoring weft yarns 4*b*, so that they remain not visible or hardly visible looking at the textile structure 1 from the front surface F side. Efficient concealing of the anchoring interlacing points IPb may be improved by choosing for the anchoring weft yarns 4*b* a specific weft continuous thread, having a diameter smaller than that of the basic weft yarns 4*a*.

The weft yarns 4*a*, 4*b*, 4*c* may further include pattern weft yarns 4*c*. Each pattern weft yarn 4*c* exhibits exposed stretches ES superimposed over the basic weft yarns 4*a* in such a manner to face at the front surface F of the base fabric 2, as well as hidden stretches HS facing at the back surface B of the base fabric 2. Pattern interlacing points IPc are provided along the pattern weft yarn 4*c*, each between one of the exposed stretches ES and the consecutive hidden stretch, across the median lying plane P. Each exposed stretch extends between two respective pattern interlacing points IPc and overrides one or more warp yarns 3 according to a desired pattern interlacing sequence. Preferably, the pattern weft yarns 4*c* are obtained from one or more respective pattern continuous threads, which are distinguished from the weft continuous thread used for the basic weft yarns 4*a*. Different interlacing sequences for the respective pattern weft yarns 4*c* may be selected and combined according to a pre-established weaving program, to form any desired figures, symbols or writes over the front surface F of the base fabric 2.

Preferably, the pattern weft yarns 4*c* cover by their exposed stretches ES the underlying basic weft yarns 4*a* and/or anchoring weft yarns 4*b* with their interlacing points IPa, IPb. These measures further improve concealing of the anchoring interlacing points IPb, to make them not visible looking at the textile structure 1 from the front surface F side. Efficient concealing may be improved by choosing for the pattern weft yarns 4*c* a diameter greater than that of the basic weft yarns 4*a* and/or anchoring weft yarns 4*b*.

The textile structure 1 further comprises one or more functional threads 5, which extend according to a pre-established pattern at the back surface B of the base fabric 2. The functional threads 5 may for example consist of electric conductive threads which function as an antenna, to form an RFID system in combination with an RFID chipset to be associated with the textile structure 1. In such a case, the functional threads 5 may extend each according to a waveform pattern, exhibiting warp-wise stretches 5*a* extending along the warp direction WR interspersed in alternate sequence with weft-wise stretches 5*b* extending along the weft direction WF or anyway transverse to the warp direction WR.

In different embodiments, the functional threads 5 may be used for transporting electric current or signals. The functional threads 5 may also be realized in the form of optical fiber.

Each functional thread 5 lies at the back surface B of the base fabric 2, without crossing the median lying plane P, and is linked with one or more of the weft yarns 4*a*, 4*b*, 4*c*. More particularly, linking of the functional thread 5 with the base fabric 2 is preferably achieved by the anchoring weft yarns 4*b*. Indeed, the functional thread 5 is preferably linked to one or more of the anchoring weft yarns 4*b* by stitching points SP positioned between the median lying plane P and the back surface B of the base fabric 2. The functional thread 5 and the stitching points SP are therefore not visible from the front surface F opposite to the back surface B, even in the absence of the pattern weft yarns 4*c*. Moreover, the positioning of the stitching points SP is such that their presence does not affect the correct positioning of the basic weft yarns 4*a* and/or pattern weft yarns 4*c* at the front surface F.

More particularly, in the first, second and third embodiments better shown in FIGS. 2-3, 11 and 16, respectively, the stitching points SP are formed along one or more fixing yarns 6, which are used for linking the functional thread 5 to the anchoring weft yarns 4*b*. Indeed, each fixing yarn 6 is interlaced with the respective anchoring weft yarns 4*b*, as well as with the functional thread 5 placed against the back surface B of the base fabric 2.

Figure 3:
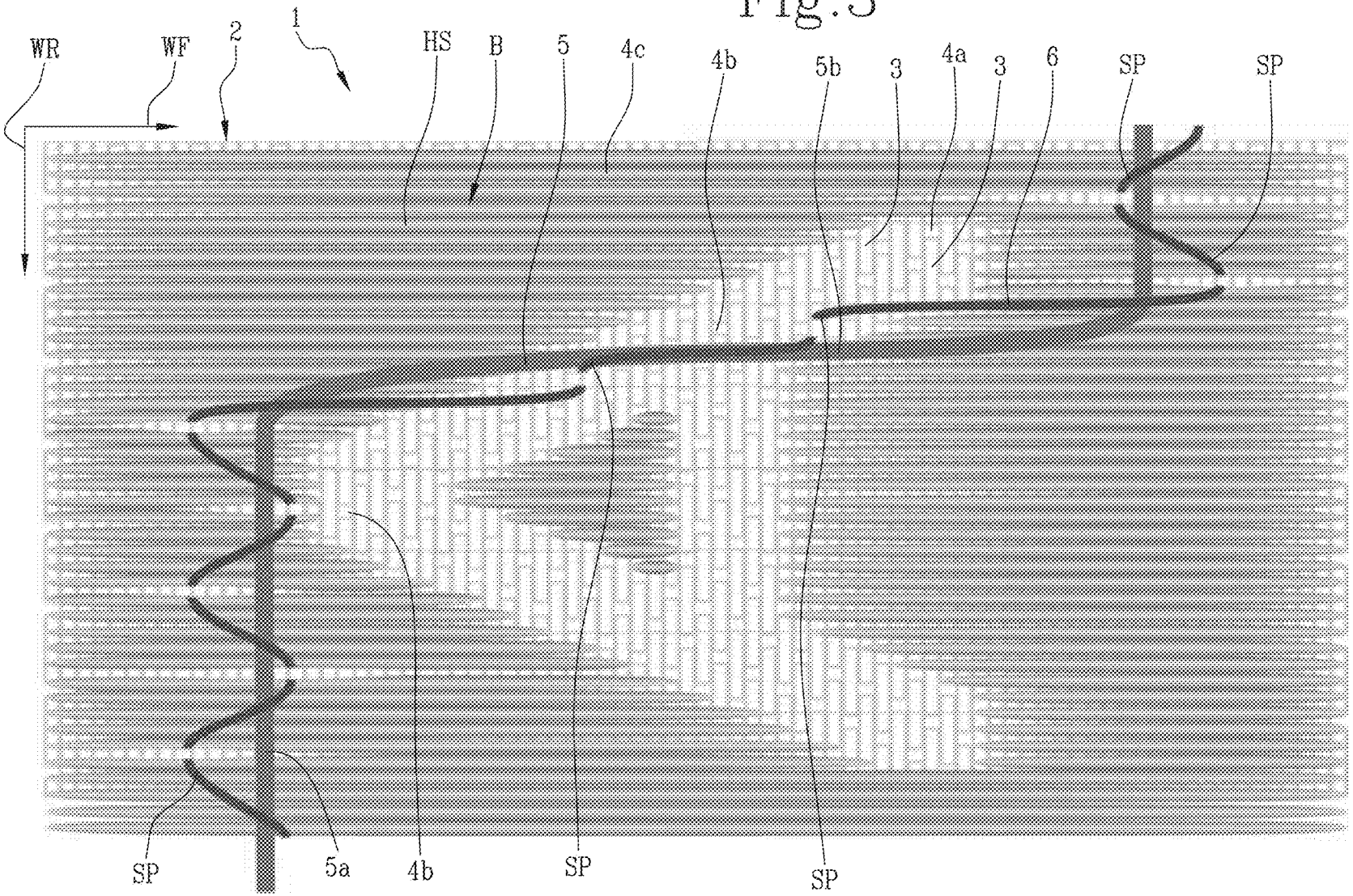
FIG. 3 is a bottom view of the textile structure of FIG. 2 according to a first embodiment, seen toward the back surface of the base fabric.

According to the first embodiment better shown by FIGS. 2 and 3, each functional thread 5 may be linked to the base fabric 2 by a single fixing yarn 6 substantially extending according to a zig-zag pattern overriding the functional thread 5 along the longitudinal development thereof. Such fixing yarn 6 engages some of the anchoring weft yarns 4*b* and the functional thread 5 at the respective stitching points SP distributed along both the weft-wise stretches 5*b* and warp-wise stretches 5*a*.

As clearly derivable from FIG. 2, the stitching points SP are positioned at the back surface B, so that neither the functional thread 5 nor the fixing yarns 6 cross the median lying plane P of the base fabric 2.

The textile structure 1 may be conveniently produced by a textile machine 7 equipped with a device for incorporating additional knitting and/or cover threads. Only some parts of the textile machine 7 will be discussed in the following description. Other parts are not shown nor described herein in detail, as they can be made in any convenient manner. The textile machine 7 may be, for example, a needle loom, a rapier loom, or other kind of weaving loom. For example, a weaving loom of the type already known from WO 2017/042015 A1 in the name of the same applicant may be used to achieve the present invention.

The basic operational cycle for forming the base fabric 2 occurs in a known manner, whereby the warp yarns 3 extending along a warp direction WR, are arranged to form a first series S1 of warp yarns 3 and a second series S2 of warp yarns 3, mutually alternated according with a pre-established weaving program. The warp yarns 3 respectively belonging to the first series S1 and second series S2 are mutually diverged, to form an open shed 8 across which at least one weft yarn 4*a*, 4*b*, 4*c* is inserted by a weft insertion device 9, along the weft direction WF transverse to the warp direction WR.

The warp yarns 3 belonging to the first series S1 and second series S2 are then mutually swapped to interlace with the weft yarn 4*a*, 4*b*, 4*c* at a weaving region 10, at which the first series S1 and second series S2 of warp yarns 3 mutually converge. The base fabric 2 is thus formed by the weft yarns 4*a*, 4*b*, 4*c* interlaced with the warp yarns 3 at the respective interlacing points IPa, IPb, IPc. A movable reed 11 provides for compacting the weft yarn 4*a*, 4*b*, 4*c* against the previously formed base fabric 2 at the weaving region 10.

During the weaving process, changes in the mutual distribution sequence among the warp yarns respectively assigned to the first series S1 and second series S2, and/or insertion in the open shed 8 of a distinct weft thread in addition or substitution to a weft thread used to form the basic weft yarns 4*a*, allow to achieve the insertion of the anchoring weft yarns 4*b* according to a desired sequence into the base fabric 2.

FIGS. 4 to 10, each representing several different rotation angles of a main shaft on which movement of movable parts of the textile machine 7 depends, show several phases for engagement of the functional thread 5 and fixing yarn 6 to the base fabric 2, in order to achieve the embodiment of FIGS. 2 and 3. The pattern weft yarns 4*c* and related mechanical components of the textile machine 7 are not shown here, as they may operate in any known manner.

Figure 4:
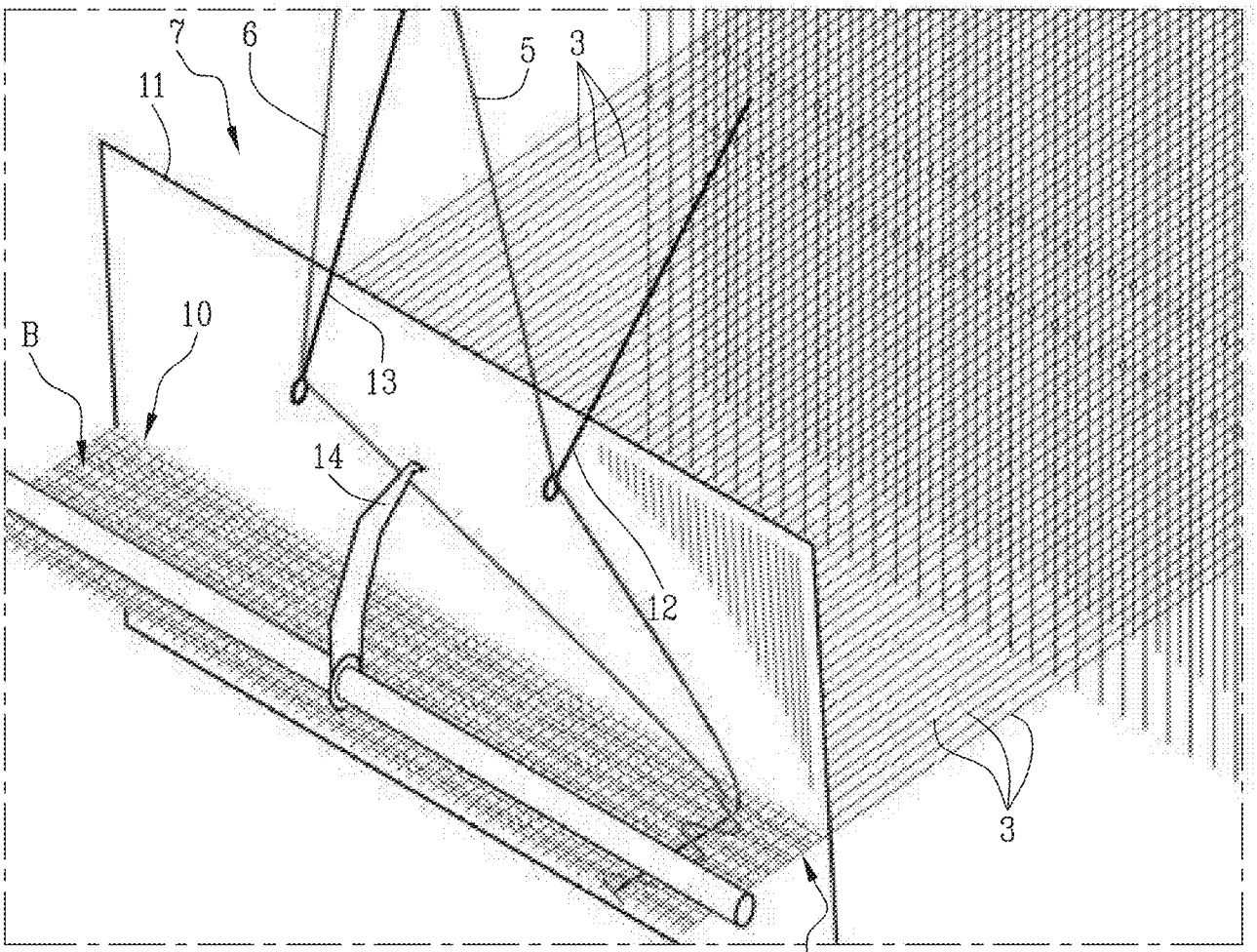
FIGS. 4 to 10 schematically show in perspective view respective phases of a process for manufacturing the textile structure according to the first embodiment.

In FIG. 4 (main shaft rotation angle=0°), the functional thread 5 and the fixing yarn 6 are carried by a functional thread guide 12 and a fixing yarn guide 13, respectively, independently movable over the weaving region 10. Both the functional thread guide 12 and fixing yarn guide 13 are at a raised position with respect to the weaving region 10. The shed 8 formed by the warp yarns 3 is closed, and the reed 11 is advanced in a beat-up position at the weaving region 10, for compacting the previously inserted basic weft yarn 4*a*, 4*b*, 4*c* against the base fabric 2. A warp-wise stretch 5*a* of the functional thread 5 is already fixed on the back surface B of the base fabric 2, by the fixing yarn 6 extending according to a zig-zag pattern.

Figure 5:
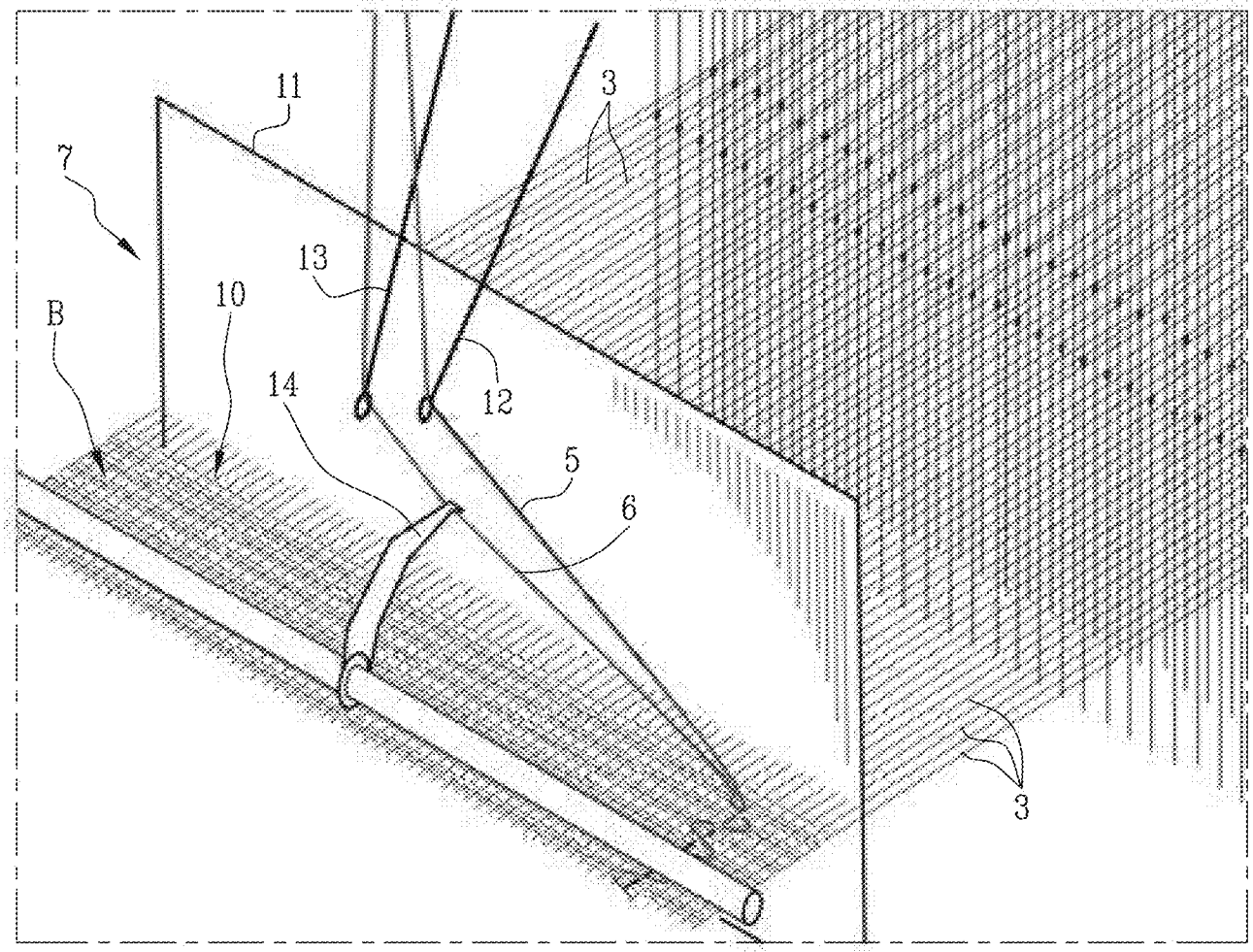

In FIG. 5 (main shaft rotation angle=10°), both the functional thread guide 12 and fixing yarn guide 13 at their raised positions move along the weft direction WF, while the reed 11 starts moving backward from the beat-up position, i.e. away from the weaving region 10. The fixing yarn guide 13 and functional thread guide 12 may be configured to copy the movement of the reed 11 along the warp direction WR. However, the fixing yarn guide 13 is slightly advanced (i.e. farther away from the reed 11 and closest to the hook member 14) with respect to the functional thread guide 12, so that the fixing yarn 6 is engaged by a movable hook member 14 operating above the weaving region 10.

Figure 6:
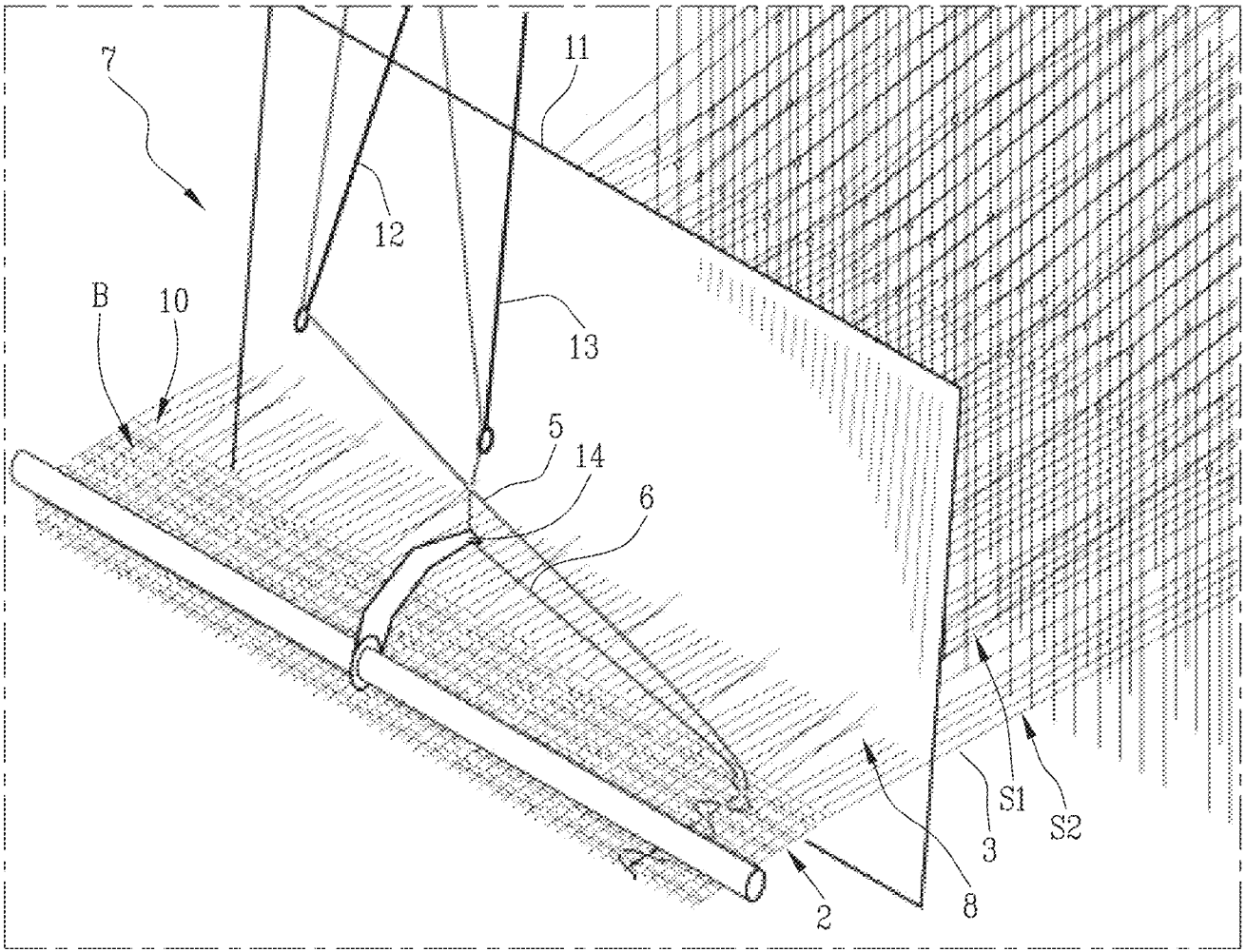

In FIG. 6 (main shaft rotation angle=30°), the reed 11 keeps moving backward, while the shed 8 starts to open. The fixing yarn guide 13 starts to move back, winding the fixing yarn 6 around the hook member 14. Meanwhile, the functional thread guide 12 moving in the weft direction WF overtakes the fixing yarn guide 13 to extend the functional thread 5 behind the fixing yarn 6.

Figure 7:
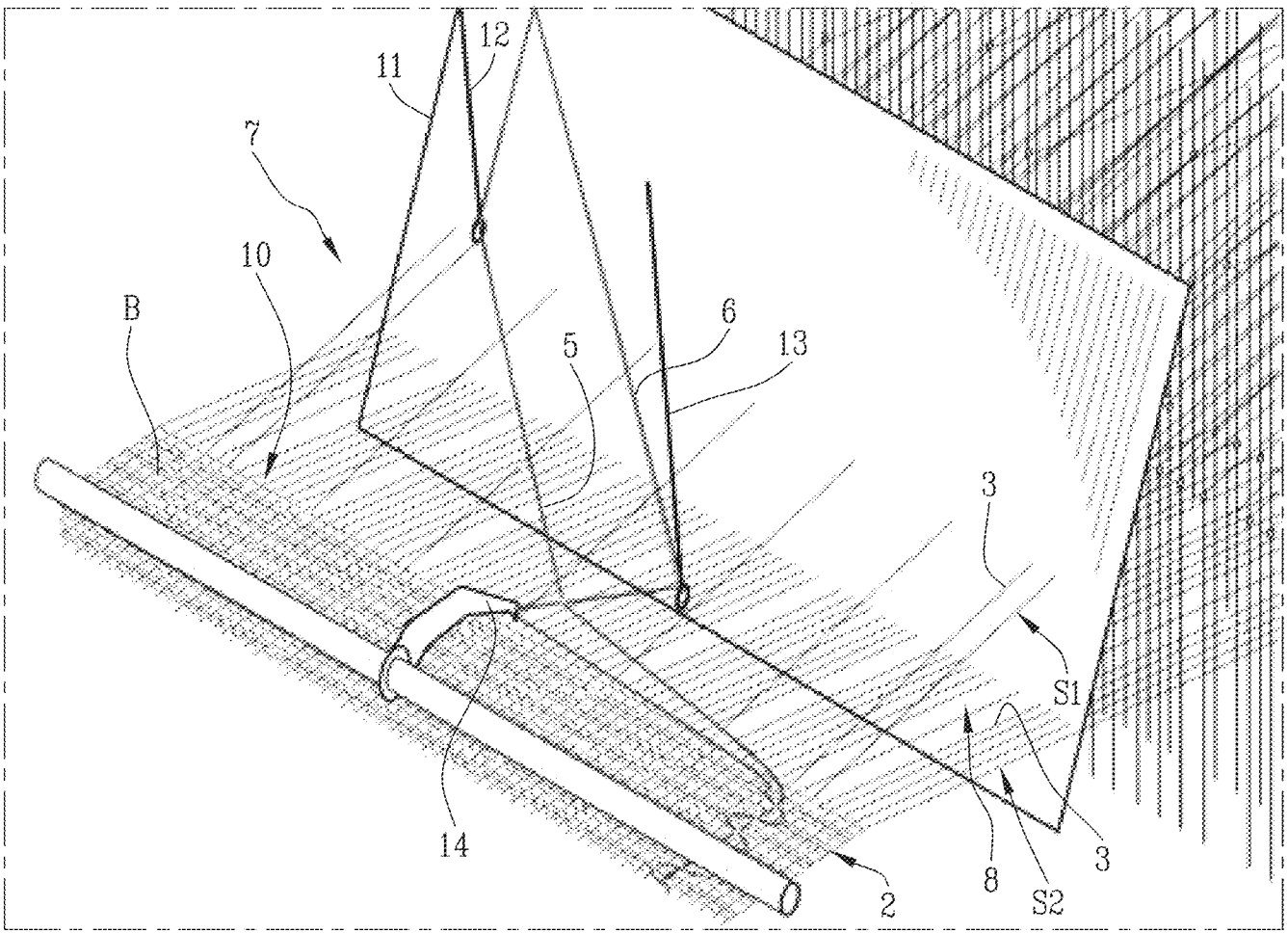

In FIG. 7, (main shaft rotation angle=60°), the reed 11 still keeps moving backward, while opening of the shed 8 proceeds on. The hook member 14 lowers the fixing yarn 6 on the base fabric 2, while the fixing yarn guide 13 moves down from the raised position and enters the shed 8 at a pre-determined position, to insert the fixing yarn 6 in the open shed 8 across the first series S1 of warp yarns 3. Meanwhile, the functional thread 5 is engaged by the fixing yarn 6 and lowered towards the base fabric 2 along with the fixing yarn 6 engaged thereto. The functional thread 5 is therefore laid down at the weaving region 10, over the warp yarns 3.

Figure 8:
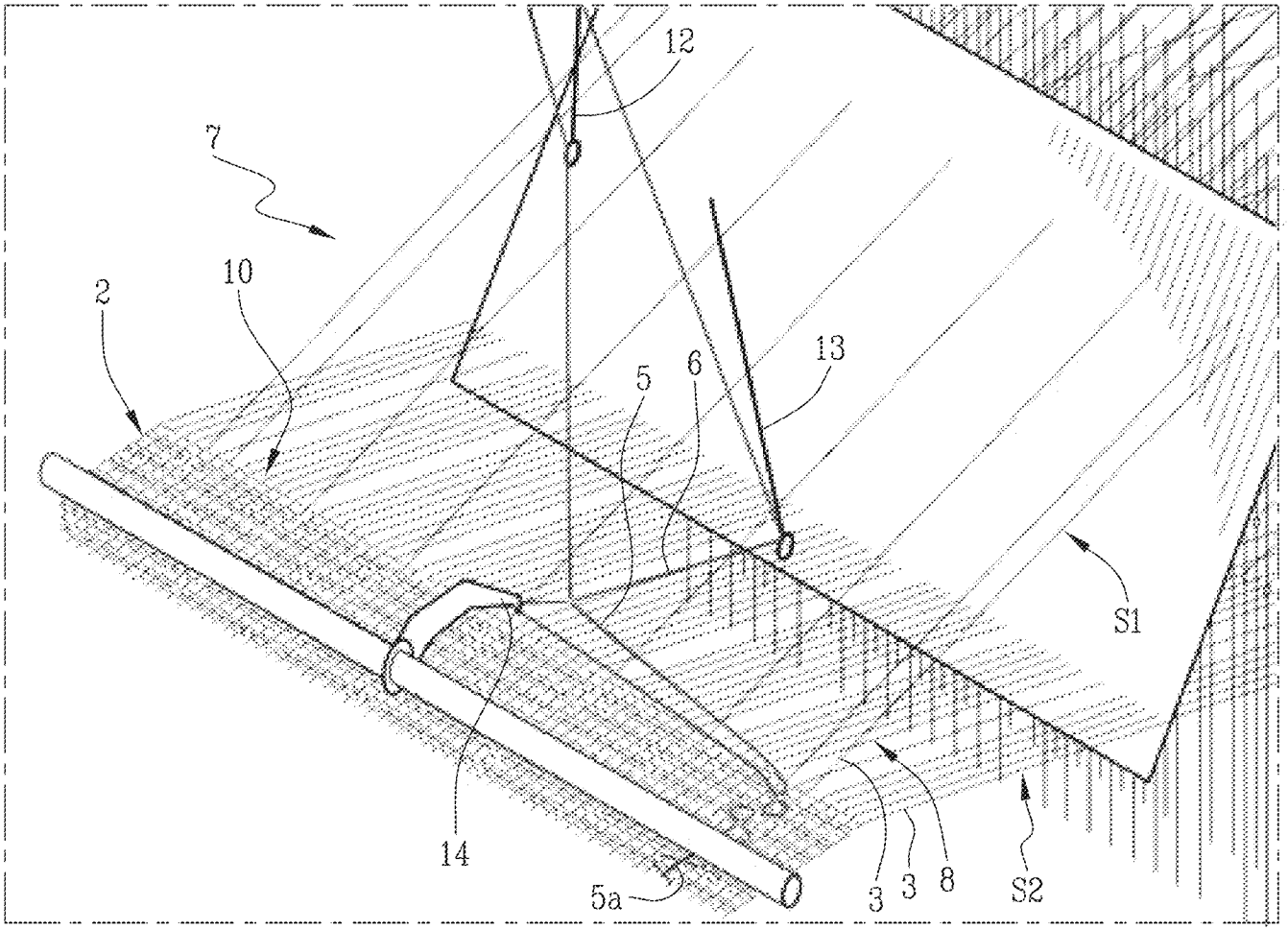

In FIG. 8 (main shaft rotation angle=90°), the reed 11 still keeps moving backward, while opening of the shed 8 is going to be completed. The hook member 14 holds the fixing yarn 6 on the base fabric 2, while the fixing yarn guide 13 moves backward together with the reed 11. The functional thread 5 remains engaged by the fixing yarn 6 and lowered towards the base fabric 2, without crossing the median lying plane P.

Figure 9:
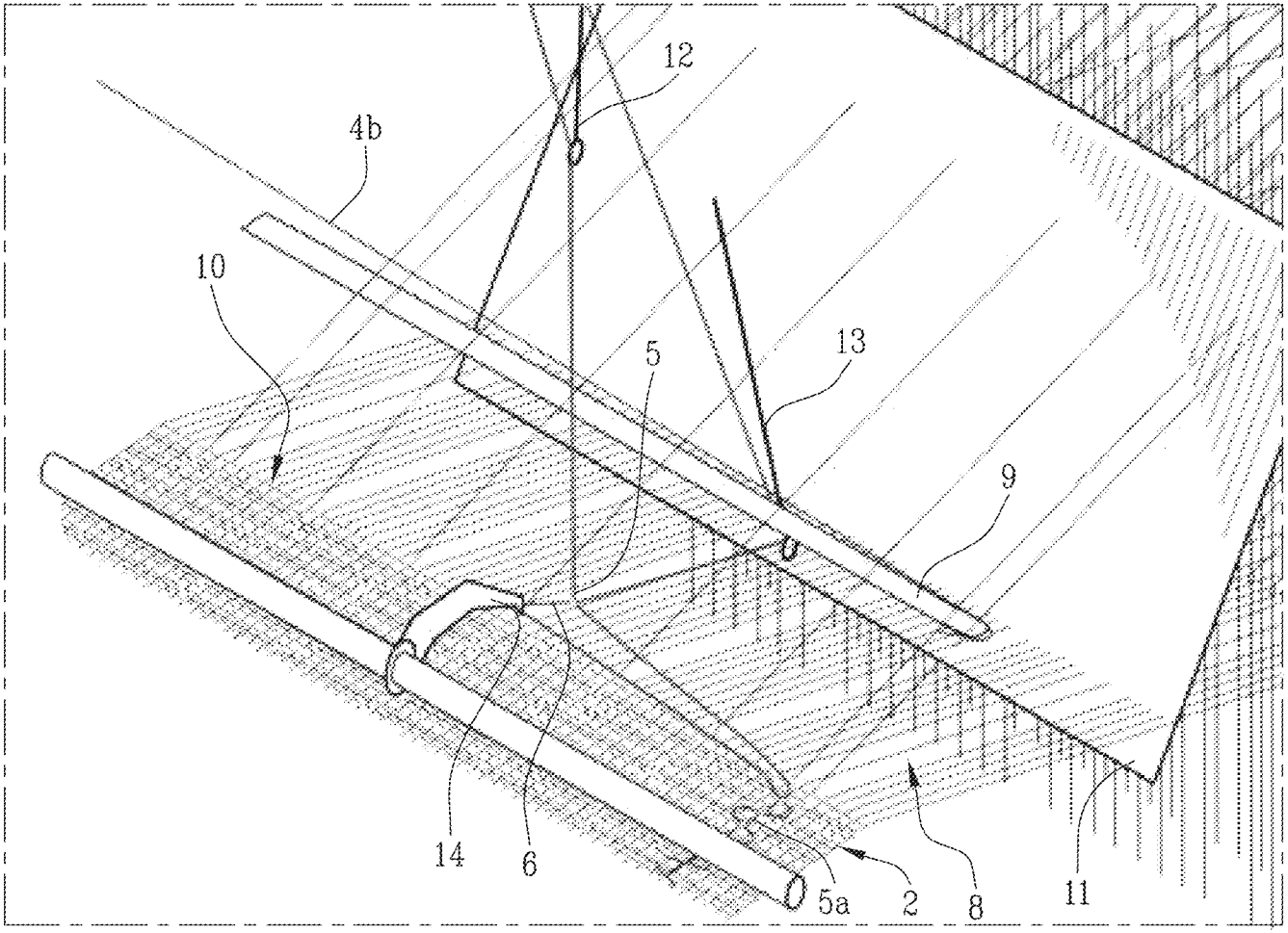

In FIG. 9 (main shaft rotation angle=180°), the weft insertion device 9 inserts the anchoring weft yarn 4*b* along the weft direction WF through the open shed 8, so to interlace with the fixing yarn 6 dipped into the shed 8 through the warp yarns 3.

Figure 10:
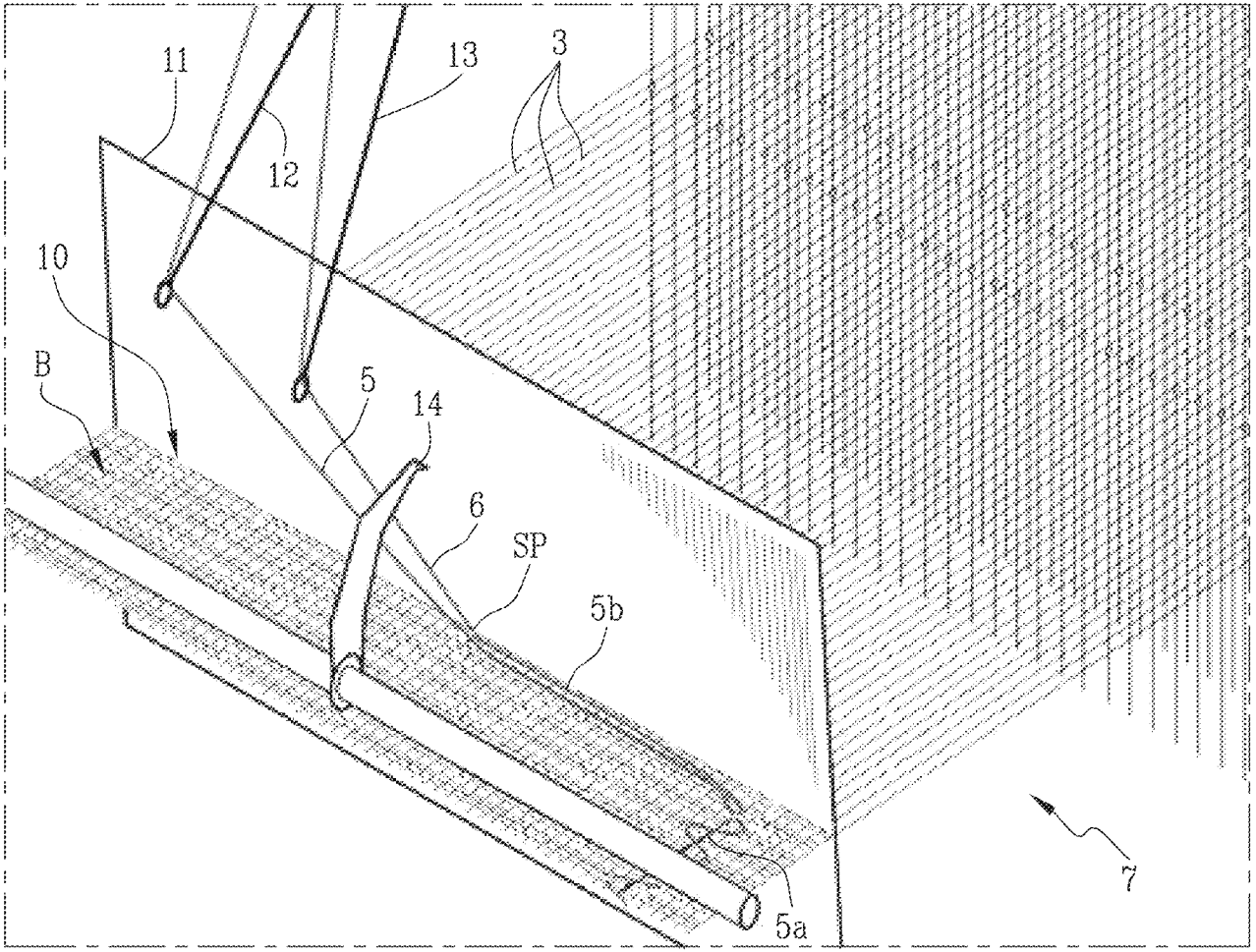

In FIG. 10 (main shaft rotation angle=360°), the reed 11 returns to the beat-up position for compacting the anchoring weft yarn 4*a*, 4*b*, 4*c* against the already formed base fabric 2, together with the functional thread 5 and fixing yarn 6. Meanwhile, the hook member 14 releases the fixing yarn 6. A stitching point SP is thus formed by the fixing yarn 6, engaging with the anchoring weft yarn 4*b* and the functional thread 5, along the weft-wise stretch 5*b* thereof. The functional thread 5 is therefore linked to the base fabric 2, while the stitching point SP remains placed between the median lying plane P and the back surface B, thus being not visible from the front surface F of the base fabric 2.

In a subsequent operating cycle, the functional thread 5 may be laid and fixed to the base fabric 2 in a similar manner.

In a known manner, the basic weft yarns 4*a* and pattern weft yarns 4*c* may be inserted across the open shed 8 together with the anchoring weft yarn 4*b* and/or during subsequent weaving cycles, to form the textile structure 1. The functional thread guide 12 and fixing yarn guide 13 are independently movable one with respect to the other, so that the deposition pattern of the functional thread 5 and fixing yarn 6 may be independently changed at each operation cycle, to confer any desired final shape to the functional thread 5. In particular, when the warp-wise stretch 5*a* of the functional thread 5 is formed, the movement of the functional thread guide 12 in the weft direction WF is stopped and the fixing yarn 6 is interlaced by the weft yarns 4*a*, 4*b*, 4*c* at stitching points SP distributed at opposite sides of the functional thread 5, along the longitudinal development of the latter.

Figure 11:
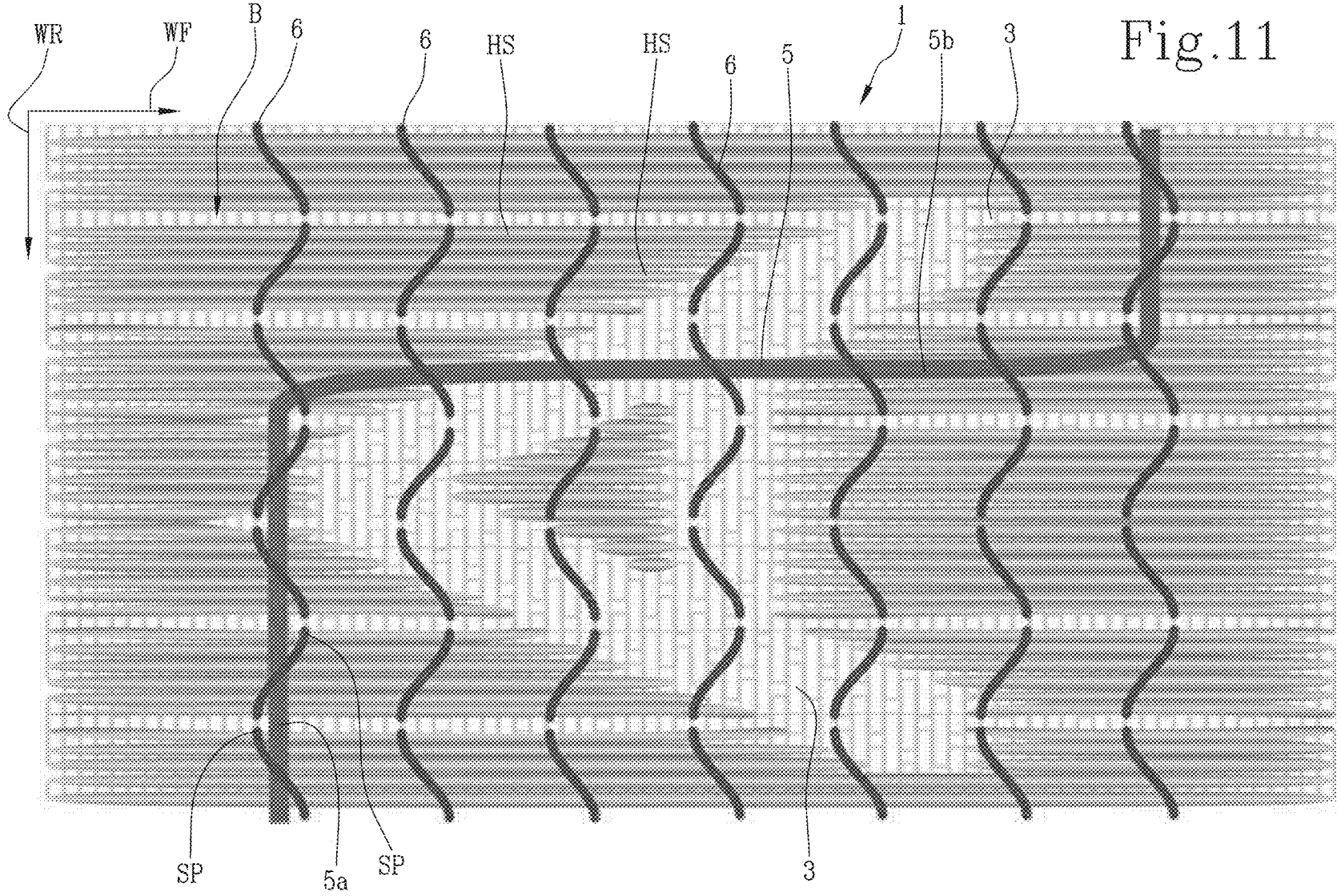
FIG. 11 is a bottom view similar to FIG. 3, of the textile structure according to a second embodiment.
Figure 16:
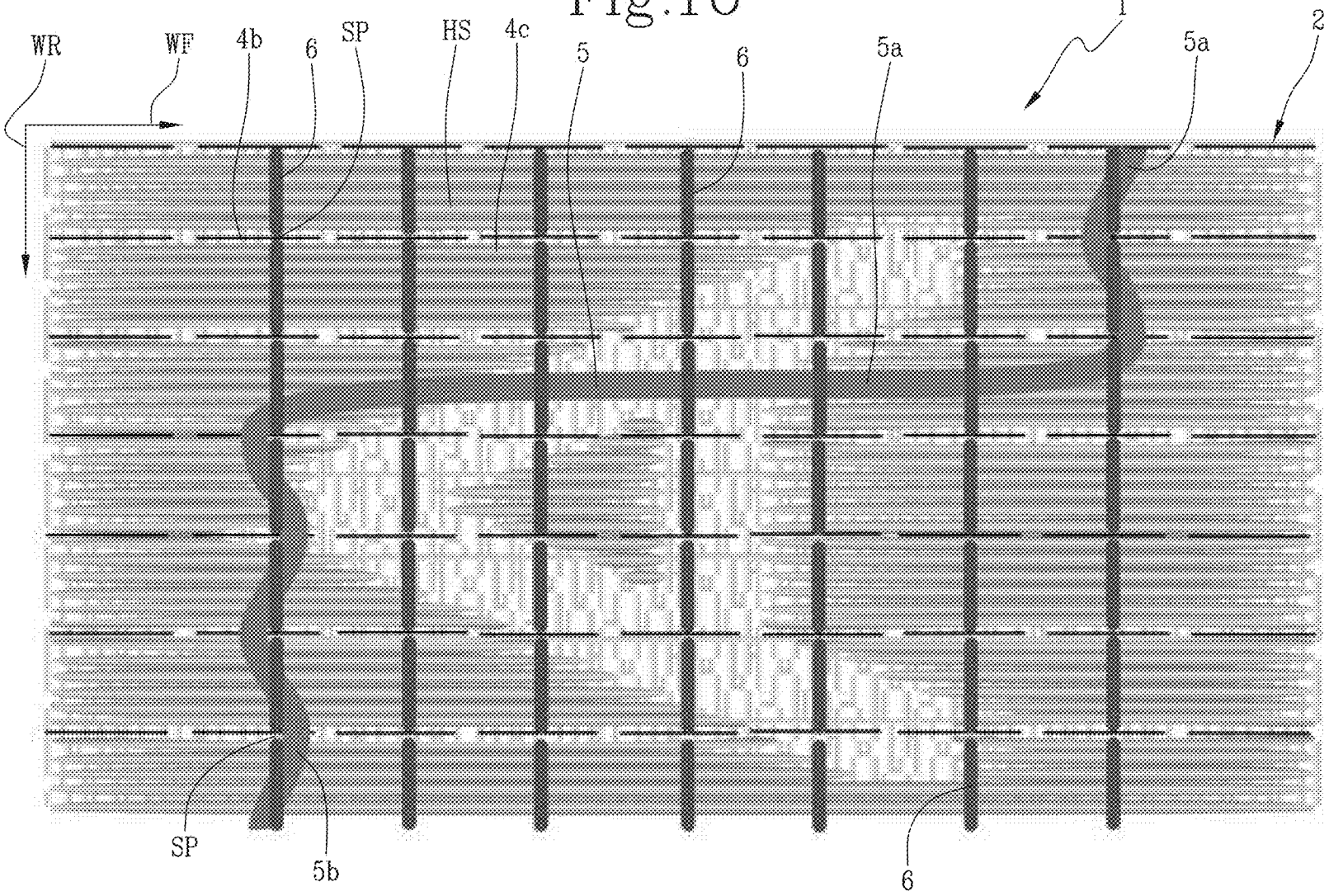
FIG. 16 is a bottom view of a third embodiment.

In the second and third embodiments of FIGS. 11 and 16, a plurality of fixing yarns 6, extending mutually parallel each substantially along the warp direction WR, is provided for each functional thread 5.

According to FIG. 11, each fixing yarn 6 may be stitched to the anchoring weft yarns 4*b* by stitching points SP homogeneously distributed according to a zig-zag pattern developing along the warp direction WR. Accordingly, the fixing yarns 6 extend according to a zig-zag pattern too. For some of the fixing yarns 6—namely those placed at opposite sides of the plurality of the fixing yarns 6 provided for a same functional thread 5—their zig-zag pattern overrides the functional thread 5 along the longitudinal development thereof, at the respective warp-wise stretches 5*a*. The other fixing yarns 6 transversely override the functional thread 5 along the warp direction WR, substantially perpendicularly at the respective weft-wise stretches 5*b*.

Several phases of the engagement of the functional thread 5 and fixing yarn 6 to the base fabric 2 according to the manufacturing process of the embodiment of FIG. 11 are schematically illustrated by FIGS. 12*a* to 15*b*, at respective different rotation angles of the main shaft of the textile machine 7. Three distinct functional threads 5 are simultaneously engaged to the base fabric 2 in this example. In this case too, the pattern weft yarns 4*c* and related mechanical components of the textile machine 7 are not shown.

FIGS. 12*a* and 12*b* (main shaft rotation angle=0°), represent the end of a previous weaving cycle, wherein the shed 8 formed by the warp yarns 3 is closed and the reed 11 is placed at the beat-up position.

Fixing yarn guides 13, one for each respective fixing yarn 6, and the functional thread guides 12 are at their raised positions over the weaving region 10. The hook member 14 is raised over the weaving region 10 too. FIGS. 13*a* and 13*b* (main shaft rotation angle equal or slightly greater than 0°), represent the start of a new weaving cycle. The shed 8 is still closed, and the reed 11 remains at the beat-up position.

The fixing yarn guides 13 slightly move along the weft direction WF to shift each fixing yarn 6 over the respective warp yarn 3 in the base fabric 2. The functional thread guides 12 move along the weft direction WF to extend the weft-wise stretch 5*b* of the respective functional threads 5 over the weaving region 10. The hook member 14 starts moving down toward the weaving region 10.

FIGS. 14*a* and 14*b* (main shaft rotation angle=180°), represent a subsequent operational phase wherein the shed 8 formed by the warp yarns 3 is open, and the reed 11 moved backward from the beat-up position. The fixing yarn guides 13 and functional thread guides 12 may be configured to copy the movement of the reed 11 along the warp direction WR, with the fixing yarn guides 13 slightly advanced (i.e. farther away from the reed 11 and closest to the hook member 14) with respect to the functional thread guides 12. The fixing yarn guides 13 move down from their raised positions and enter the shed 8 each at a pre-determined position, so that the fixing yarns 6 are inserted down in the open shed 8 through the first series S1 of warp yarns 3.

Meanwhile, the hook members 14 move down toward the base fabric 2, so to engage the functional threads 5 over the weaving region 10. Each functional thread 5 is therefore held at the weaving region 10, over the warp yarns 3, without crossing the median lying plane P, whereas the respective fixing yarns 6 are dipped into the shed 8 through the warp yarns 3 and stitched over the respective functional threads 5, e.g. at the weft-wise stretches 5*b* thereof. Thereafter, the weft insertion device 9 inserts the anchoring weft yarn 4*b* along the weft direction WF through the open shed 8, so to interlace with the fixing yarns 6.

FIGS. 15*a* and 15*b* (main shaft rotation angle=360°) represent the end of the new weaving cycle, wherein the shed 8 is newly closed while the reed 11 had been moved again to the beat-up position for compacting the anchoring weft thread against the base fabric 2 previously formed at the weaving region 10. The hook member 14 released the functional yarn, while fixing yarn guides 13 retracted to their raised position and moved over the base fabric 2 together with the functional threads 5 guides and the reed 11.

In this embodiment too, the basic weft yarns 4*a* and pattern weft yarns 4*c* are inserted across the open shed 8 along with the anchoring weft yarn 4*b* and/or during subsequent weaving cycles, to form the textile structure 1.

The independent movement of the functional thread guides 12 and fixing yarn guides 13, especially along the weft direction WF, allows the deposition design of the functional thread 5 and fixing yarn 6 to be changed as desired at each operation cycle. In particular, movement of the functional thread guides 12 in the weft direction WF can be stopped during several subsequent weaving cycles, to form the warp-wise stretches 5*a* of the functional threads 5, while the fixing yarns 6 are interlaced by the weft yarns 4*a*, 4*b*, 4*c* at stitching points SP distributed at opposite sides of the functional thread 5, along the longitudinal development of the latter.

A possible alternative embodiment shown in FIG. 16 may be obtained by stopping movement of the fixing yarn guides 13 along the weft direction WF and slightly moving the functional threads 5 guides during deposition of the warp-wise stretches 5*a*. This alternative embodiment differs from the one disclosed with reference to FIG. 13, in that the fixing yarns 6 extend straight with all their stitching points SP mutually aligned along the warp direction WR. In this case, the warp-wise stretches 5*a* of the functional thread 5 extend according to a zig-zag pattern around the aligned stitching points SP formed by the respective fixing yarns 6. The weft-wise stretches 5*b* of the functional thread 5 are fixed between two consecutive stitching points SP of each of the respective fixing yarns 6.

Figure 18:
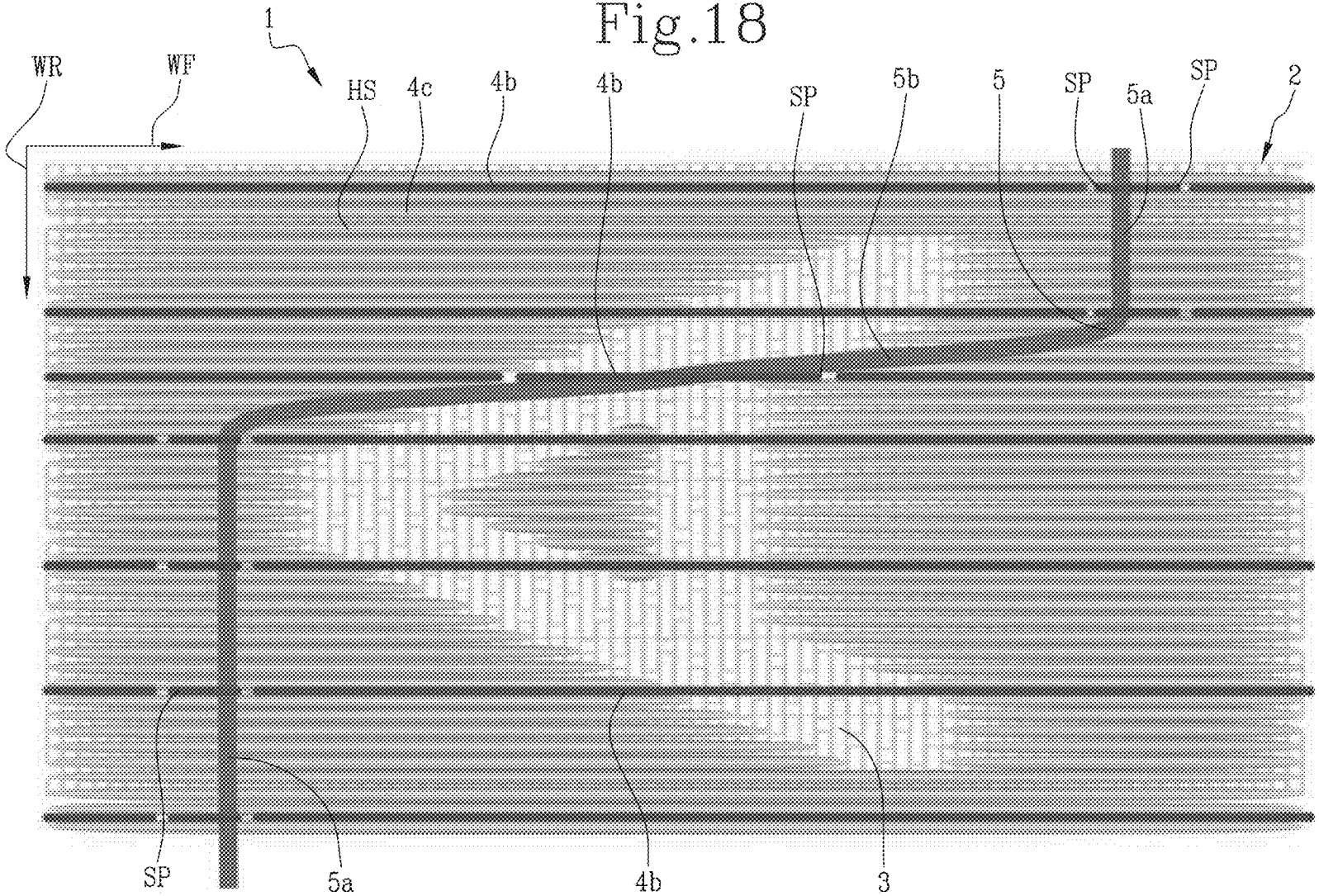
FIG. 18 is a bottom view of the fourth embodiment.

In the further alternative embodiment shown in FIGS. 17 and 18, the weft yarns 4*a*, 4*b*, 4*c*, namely the anchoring weft yarns 4*b*, directly engage the functional thread 5 at the back surface B of the base fabric 2, so to form stitching points SP placed between the median lying plane P and the back surface B, as derivable from FIG. 17.

As shown in FIG. 18, the warp-wise stretches 5*a* of the functional thread 5 are each engaged by several anchoring weft yarns 4*b*, each at respective stitching points SP aligned along the warp direction WR. Each stitching point SP along the weft-wise stretch 5*b* remains fixed between two interlacing points IPb formed along a same anchoring weft yarn 4*b*, diagonally crossed by the weft-wise stretch 5*b*.

This embodiment may simplify the construction and manufacturing of the textile structure 1, especially when the functional thread 5 is strong enough to bear greater stresses applied during manufacturing.

Embodiment such as illustrated in FIGS. 17 and 18 may be obtained by an arrangement similar to those of FIGS. 4 to 10 and 12 to 15, without using the fixing yarn guides 13 and arranging the functional thread guides 12 for entering through the warp yarns 3 in the open shed 8, to cause the functional threads 5 to be interlaced at the respective stitching points SP by the anchoring weft yarns 4*b*, similar to what previously discloses with reference to the fixing yarns 6.

The invention claimed is:

1. Textile structure comprising:

a base fabric including warp yarns extending along a warp direction and weft yarns extending along a weft direction;

wherein the base fabric presents a front surface and a back surface at mutually opposite sides with respect to a median lying plane of the base fabric;

wherein the weft yarns interlace with the warp yarns at respective interlacing points at which the weft yarns cross the median lying plane to override at least one of the warp yarns;

further comprising at least one functional thread extending according to a pre-established pattern at the back surface of the base fabric;

wherein the at least one functional thread lies on the base fabric without crossing the median lying plane; and wherein the functional thread is linked with one or more of the weft yarns at stitching points positioned between the median lying plane and the back surface of the base fabric, so that the stitching points are not visible from the front surface opposite to the back surface.

2. Textile structure according to claim 1, wherein the weft yarns include:

mutually parallel basic weft yarns;

anchoring weft yarns configured for linking the at least one functional thread with the base fabric;

wherein interlacing points formed by the anchoring weft yarns are staggered along the weft direction, with respect to interlacing points formed by the basic weft yarns.

3. Textile structure according to claim 1, wherein on the front surface of the base fabric, the basic weft yarns present floating stretches each extending straight over a group of the warp yarns between respective interlacing points, the floating stretches of mutually adjacent basic weft yarns covering the interlacing points of the anchoring weft yarns.

4. Textile structure according to claim 1, wherein the weft yarns further include pattern weft yarns having exposed stretches facing at the front surface of the base fabric over the basic weft yarns, and hidden stretches facing at the back surface of the base fabric.

5. Textile structure according to claim 1, further comprising at least one fixing yarn interlaced with said weft yarns and at least one functional thread at the back surface of the base fabric, to link the functional thread with the base fabric.

6. Textile structure according to claim 5, wherein the at least one fixing yarn is interlaced with said anchoring weft yarns.

7. Textile structure according to claim 5, wherein the at least one fixing yarn extends according to a zig-zag pattern overriding the functional thread along the longitudinal development thereof.

8. Textile structure according to claim 1, wherein each of said at least one functional thread is interlaced with the anchoring weft yarns by a plurality of mutually parallel fixing yarns, each substantially extending along the warp direction.

9. Textile structure according to claim 5, wherein at least one of the fixing yarns extends according to a zig-zag pattern overriding warp-wise stretches of the functional thread.

10. Textile structure according to claim 5, wherein at least one warp-wise stretch of the functional thread extends according to a zig-zag pattern overriding one of the fixing yarns.

11. Textile structure according to claim 1, wherein the weft yarns directly engage with the functional thread at the back surface of the base fabric.

12. Process for manufacturing a textile structure comprising:

arranging warp yarns extending along a warp direction, according to a first series of warp yarns mutually alternated with a second series of warp yarns;

inserting weft yarns along a weft direction transverse to the warp direction, across an open shed formed by the first series and second series mutually converging at a weaving region along the warp direction;

mutually swapping the first series and second series to interlace the weft yarn with the warp yarns at the weaving region, whereby a base fabric is formed by the weft yarns interlaced with the warp yarns at respective interlacing points;

laying at least one functional thread on the warp yarns near the weaving region, the functional thread lying on a back surface of the base fabric, without crossing a median lying plane of the base fabric;

linking the at least one functional tread to the weft yarns by stitching points placed between the median lying plane and the back surface, so that the stitching points are not visible from a front surface of the base fabric opposite to the back surface.

13. Process according to claim 12, wherein inserting the weft yarns includes inserting basic weft yarns and inserting anchoring weft yarns across the open shed at respectively subsequent weaving cycles, the functional thread being linked to the anchoring weft yarns.

14. Process according to claim 12, wherein linking the at least one functional thread comprises forming by a fixing yarn at least one stitching point engaging the anchoring weft yarn and the functional thread.

15. Process according to claim 12, further comprising:

inserting the functional thread in the open shed across one of said first series and second series of the warp yarns, and interlacing the functional thread by the weft yarns introduced across the open shed.

* * * * *